US010501987B2

(12) United States Patent
De Frene et al.

(10) Patent No.: US 10,501,987 B2
(45) Date of Patent: Dec. 10, 2019

(54) SCREEN DEVICE

(71) Applicant: RENSON SUNPROTECTION-SCREENS NV, Waregem (BE)

(72) Inventors: Joost Benjamin Renaat De Frene, Waregem (BE); John Peter Meinster, Gentbrugge (BE)

(73) Assignee: RENSON SUNPROTECTION-SCREENS NV, Waregem (BE)

( * ) Notice: Subject to any disclaimer, the term of this patent is extended or adjusted under 35 U.S.C. 154(b) by 0 days.

(21) Appl. No.: 15/772,526

(22) PCT Filed: Oct. 28, 2016

(86) PCT No.: PCT/IB2016/056500
§ 371 (c)(1),
(2) Date: Apr. 30, 2018

(87) PCT Pub. No.: WO2017/072709
PCT Pub. Date: May 4, 2017

(65) Prior Publication Data

US 2018/0313145 A1 Nov. 1, 2018

(30) Foreign Application Priority Data

Oct. 30, 2015 (BE) ..... 2015/5709

(51) Int. Cl.
*E06B 9/40* (2006.01)
*E04F 10/06* (2006.01)
(Continued)

(52) U.S. Cl.
CPC ..... *E06B 9/40* (2013.01); *E04F 10/0607* (2013.01); *E04F 10/0655* (2013.01); *E06B 9/42* (2013.01);
(Continued)

(58) Field of Classification Search
CPC ..... E06B 9/54; E06B 9/42; E06B 9/60; E06B 9/58; E06B 2009/583; E06B 2009/543
See application file for complete search history.

(56) References Cited

U.S. PATENT DOCUMENTS 1,893,651 A * 1/1933 Ray ..... E06B 9/54 160/21
4,252,172 A * 2/1981 Pommat ..... E06B 9/40 160/322
(Continued)

FOREIGN PATENT DOCUMENTS

DE 40 36 892 A1 5/1992
EP 0778379 A1 * 6/1997 ..... E04F 10/0607
(Continued)

OTHER PUBLICATIONS

Written Opinion and International Search Report dated Dec. 14, 2016.

*Primary Examiner* — Johnnie A. Shablack
(74) *Attorney, Agent, or Firm* — Symbus Law Group, LLC; Clifford D. Hyra

(57) ABSTRACT

A screen device (1), comprising a screen roller (2), a screen (3) which can be rolled up and unrolled hereon, an end lath (4), which is fitted to an opposite side of the screen (3), and a tensioning system (8) to tension the screen (3) in the roll-up and unrolling direction, the tensioning system comprising on each lateral side of the screen (3) a band wheel (5) next to the screen roller (2), a tensioning cord (6), which can be rolled up and unrolled hereon and which, at its end away from the band wheel (5), is fastened to the end lath (4), away from the screen roller (2) a reversing wheel (7), via which the tensioning cord (6) is turned, and a spring sub-system (18), which comprises at least one spring element (9) for keeping the respective tensioning cord (6) under tension, wherein at least one of the spring sub-systems (18) com-
(Continued)

prises adjustors (10, 11, 14, 13, 16) for adjusting the spring force of the spring element (9).

12 Claims, 5 Drawing Sheets

(51) Int. Cl.
*E06B 9/42* (2006.01)
*E06B 9/58* (2006.01)
*E06B 9/60* (2006.01)
*E06B 9/54* (2006.01)

(52) U.S. Cl.
CPC ..... *E06B 9/58* (2013.01); *E06B 9/60* (2013.01); *E06B 2009/543* (2013.01); *E06B 2009/583* (2013.01)

(56) References Cited

U.S. PATENT DOCUMENTS 4,365,660 A * 12/1982 Henkenjohann ..... E06B 9/86 160/133
4,811,777 A * 3/1989 Chretien ..... E06B 9/13 160/189
4,852,627 A * 8/1989 Peterson ..... E06B 9/262 160/84.02
4,862,941 A * 9/1989 Colson ..... E06B 9/262 160/84.02
4,997,022 A * 3/1991 Klein ..... E06B 9/62 160/265
5,280,818 A * 1/1994 Ubelhart ..... E06B 9/68 160/191
5,456,303 A * 10/1995 Horinouchi ..... E06B 9/0692 160/84.04
5,752,557 A * 5/1998 Crider ..... E06B 9/13 160/121.1
6,006,811 A * 12/1999 Brutsaert ..... E04F 10/0603 135/141
7,059,376 B2 * 6/2006 Tussinger ..... E06B 9/42 160/310
7,503,370 B2 * 3/2009 Ciuca ..... E06B 9/32 160/170
8,011,413 B2 * 9/2011 Poppema ..... E05D 13/12 160/23.1
8,056,601 B2 * 11/2011 Kirby ..... E06B 9/42 160/265
9,290,990 B2 * 3/2016 Hicks ..... E06B 9/54
9,605,461 B2 * 3/2017 Zimmer ..... E05D 15/0669
9,624,722 B2 * 4/2017 Hummel ..... E06B 9/54
9,689,201 B2 * 6/2017 Riemelmoser ..... E06B 3/4609
9,739,088 B2 * 8/2017 Hicks ..... E06B 9/54
10,208,536 B2 * 2/2019 Riemelmoser ..... E06B 3/4609
2001/0042346 A1 * 11/2001 Brioschi ..... E06B 9/54 49/447
2008/0141599 A1 * 6/2008 Akdag ..... E06B 9/08 52/202
2008/0163988 A1 * 7/2008 Hicks ..... E06B 9/54 160/267.1
2014/0283634 A1 * 9/2014 Joseph ..... E06B 9/32 74/89.2
2017/0183907 A1 * 6/2017 Hummel ..... E06B 9/54
2017/0211325 A1 * 7/2017 Riemelmoser ..... E06B 9/62
2018/0305976 A1 * 10/2018 Okachi ..... E06B 9/0692
2018/0313145 A1 * 11/2018 De Frene ..... E04F 10/0655
2018/0313148 A1 * 11/2018 Hummel ..... E06B 9/54
2019/0017318 A1 * 1/2019 Smith ..... E06B 9/42
2019/0078384 A1 * 3/2019 De Frene ..... E06B 7/14

FOREIGN PATENT DOCUMENTS

EP 0911476 A1 * 4/1999 ..... E06B 9/54
EP 1158135 A1 * 11/2001 ..... E06B 9/54
EP 2392763 A3 * 12/2012 ..... E06B 9/54
EP 2662522 A2 * 11/2013 ..... E06B 9/54
GB 2535506 A * 8/2016 ..... E06B 9/42
GB 2548229 A * 9/2017 ..... E06B 9/42
GB 2539070 B * 2/2018 ..... E04F 10/0655

* cited by examiner

SCREEN DEVICE

The present application claims priority from Belgian Patent Application No. BE-2015/5709 filed on Oct. 30, 2015, which is incorporated herein by reference.

FIELD OF THE DISCLOSURE

This disclosure relates to a screen device, comprising a screen roller;

a screen which can be rolled up and unrolled on this screen roller, an end lath, which is fitted to a side of the screen opposite to the side where the screen is rolled up and unrolled;

a tensioning system to tension the screen in the roll-up and unrolling direction, comprising on each lateral side of the screen:

a band wheel, which is arranged next to the screen roller;

a tensioning cord, which can be rolled up and unrolled on this band wheel;

on the side of the screen device away from the screen roller, a reversing wheel, via which the tensioning cord is turned;

and a spring system for keeping the tensioning cords under spring tension.

By tensioning cord is here understood, inter alia, a tension cable, tension rope or tension band.

BACKGROUND

Such screen devices having vertically arranged screen rollers are described, for example, in EP 2 662 522 A2 and EP 0 911 476 A.

Tensioning systems are used in such screen devices to keep the screen tensioned in each position in which this screen is rolled up and/or unrolled, so that this screen goes on to sag as little as possible. In screen devices having a screen which can be rolled up and unrolled on an erected screen roller, it is noticed in practice, however, that the end lath, in the fully unrolled state of the screen, cannot generally connect neatly to the structure against which this screen is intended to be unrollable, since in this position it is no longer arranged parallel to the screen roller.

A solution to this problem is described in DE 40 36 892 A1. The herein described screen device comprises on each lateral side of the screen a separate spring sub-system, having a spring element for keeping the respective tensioning cord under tension. In addition, adjusting means are provided for adjusting the spring force of the spring element.

SUMMARY

An object of embodiments of this invention is to provide such a solution for a screen device, in which the spring system can also easily absorb dynamic forces which arise in the screen device.

This object of the invention may be achieved by providing a screen device, comprising:

a screen roller;

a screen which can be rolled up and unrolled on this screen roller, an end lath, which is fitted to a side of the screen opposite to the side where the screen is rolled up and unrolled;

a tensioning system to tension the screen in the roll-up and unrolling direction, comprising on each lateral side of the screen:

a band wheel, which is arranged next to the screen roller;

a tensioning cord, which can be rolled up and unrolled on this band wheel;

on the side of the screen device away from the screen roller, a reversing wheel, via which the tensioning cord is turned;

and comprising a spring system for keeping the tensioning cords under spring tension;

wherein each tensioning cord, on its end away from the band wheel, is fastened to a respective end of the end lath, wherein the spring system comprises a first spring sub-system on a first lateral side of the screen, which first spring sub-system comprises at least one spring element for keeping the respective tensioning cord under tension, and a second spring sub-system, arranged separate from the first spring sub-system, on the second lateral side of the screen, which second spring sub-system comprises at least one spring element for keeping the respective tensioning cord under tension, wherein the first spring sub-system comprises adjusting means for adjusting the spring force of the spring element, wherein each spring sub-system comprises a first pivot arm, which is articulately fastened to a first fixed pivot pin, which is fixedly arranged in the screen device and is articulately fastened to a displaceable pivot pin arranged displaceably in the screen device, and comprises a second pivot arm, which is articulately fastened to the displaceable pivot pin and is articulately fastened to a second fixed pivot pin, which is fixedly arranged in the screen device, wherein the first pivot arm comprises a first part-arm and a second part-arm, which, with the aid of the spring element, are arranged resiliently with respect to each other, so that the spring force of the spring element drives the part-arms apart, and wherein around the displaceable pivot pin is fitted a guide wheel, via which the respective tensioning cord is turned.

Similar spring systems with pivot arms are known, for example, in derailleur gears of bicycles. By virtue of such a spring system with pivot arms, the spring system can also easily absorb dynamic forces which arise in the screen device. Furthermore, by virtue of such a spring system, the spring force of the spring element can compactly be made adjustable.

This solution is particularly advantageous in erected screen rollers, but can also be useful in virtually horizontally arranged screen rollers in order to be able to absorb variances between the two lateral sides.

By an erected screen roller is here understood a screen roller which can be arranged in any arrangement different from a horizontal arrangement. Typically, such a screen roller will stand vertically arranged. However, it is also possible, for example, that this is obliquely arranged, so that this screen device can shield or liberate a window-shaped frame.

In screen devices having erected screen rollers, there will typically be a differing friction on the two lateral sides of the screen, whereby the end lath, in the fully unrolled state, is no longer arranged neatly parallel to the screen roller and can no longer neatly connect to a surrounding structure against which the screen can be unrolled. By now providing a separate spring sub-system on each lateral side of the screen and providing at least one spring sub-system with adjusting means for adjusting the spring force thereof, the variances in friction on both sides can be compensated by regulating the exerted spring force on one of the two sides until the end lath, in the unrolled state, can be placed neatly parallel to the screen roller, so that it can neatly connect up to a surrounding structure against which the screen can be unrolled.

In this case, it is of little or no importance whether this first spring sub-system is arranged at the top of the screen or at the bottom of the screen.

Preferably, also the second spring sub-system comprises adjusting means for adjusting the spring force of the spring element, so that the spring force can be regulated on both sides.

In a screen device according to an embodiment of this invention, around one of the fixed pivot pins is preferably fitted a guide wheel, via which the respective tensioning cord is turned. This guide wheel which is fitted around one of the fixed pivot pins is further preferably realized as the respective reversing wheel.

In one specific embodiment, the adjusting means of a screen device according to this invention comprise a threaded rod, a holder, through which the threaded rod is rotatably fitted with its first end, a bracing element, through which the second end of the threaded rod or an extension piece of the threaded rod is fitted displaceably according to the longitudinal direction of the threaded rod, a nut, which comprises an internal screw thread corresponding with the external screw thread of the threaded rod and is fitted between the holder and the bracing element rotatably on the threaded rod, and a rotation-blocking element, which prevents absolute rotation of the nut in the screen device and leaves a relative rotation of the nut around the threaded rod unimpeded, so that the nut, upon rotation of the threaded rod in the screen device, moves over the threaded rod in the longitudinal direction of the threaded rod. In this case, the spring element is then preferably fitted between the nut and the bracing element, so that the spring force of the spring element drives the nut and the bracing element apart.

In such an embodiment of a screen device according to this invention, the nut is preferably provided on its outer periphery with a flat side, and the rotation-blocking element preferably comprises a surface against which the nut is fitted with its flat side to prevent absolute rotation of the nut in the screen device.

If a screen device according to an embodiment of this invention comprises such adjusting means, then the threaded rod preferably forms part of the first part-arm of the first pivot arm, the holder is preferably articulately fastened to the first fixed pivot pin in order to fasten this first part-arm articulately to this first fixed pivot pin, and the bracing element preferably forms part of the second part-arm of the first pivot arm.

If a screen device comprises on each lateral side a side guide for guiding the corresponding lateral side of the screen, then the tensioning system is preferably arranged at least partially in these side guides. If such a screen device then comprises an earlier described specific embodiment of the adjusting means, then the rotation-blocking element is preferably fixedly arranged in or forms part of the corresponding side guide.

The spring elements of a screen device according to some embodiments of this invention are preferably realized as a helical spring. If such a screen device then comprises an earlier described specific embodiment of the adjusting means, then this helical spring is preferably fitted around the threaded rod. Yet more preferredly, a cylindrical tube is then fitted around the threaded rod, fastened to the nut and fitted displaceably through the bracing element as the said extension piece of the threaded rod, and the helical spring is fitted around the cylindrical tube.

BRIEF DESCRIPTION OF THE DRAWINGS

This invention is now more closely explained with reference to the hereinafter following detailed description of a preferred screen device according to this invention. The aim of this description is to provide solely illustrative examples and to indicate further advantages and particularities of this invention, and can thus not be interpreted as a limitation of the field of application of the invention or of the patent rights claimed in the claims.

In this detailed description, reference is made by means of reference numerals to the hereto appended drawings, wherein in FIG. 1 a screen device according to an embodiment of this invention is represented in front view, with cut-out side guides, in order to offer a view of the content of these side guides.

DETAILED DESCRIPTION OF EMBODIMENTS

Figure 1:
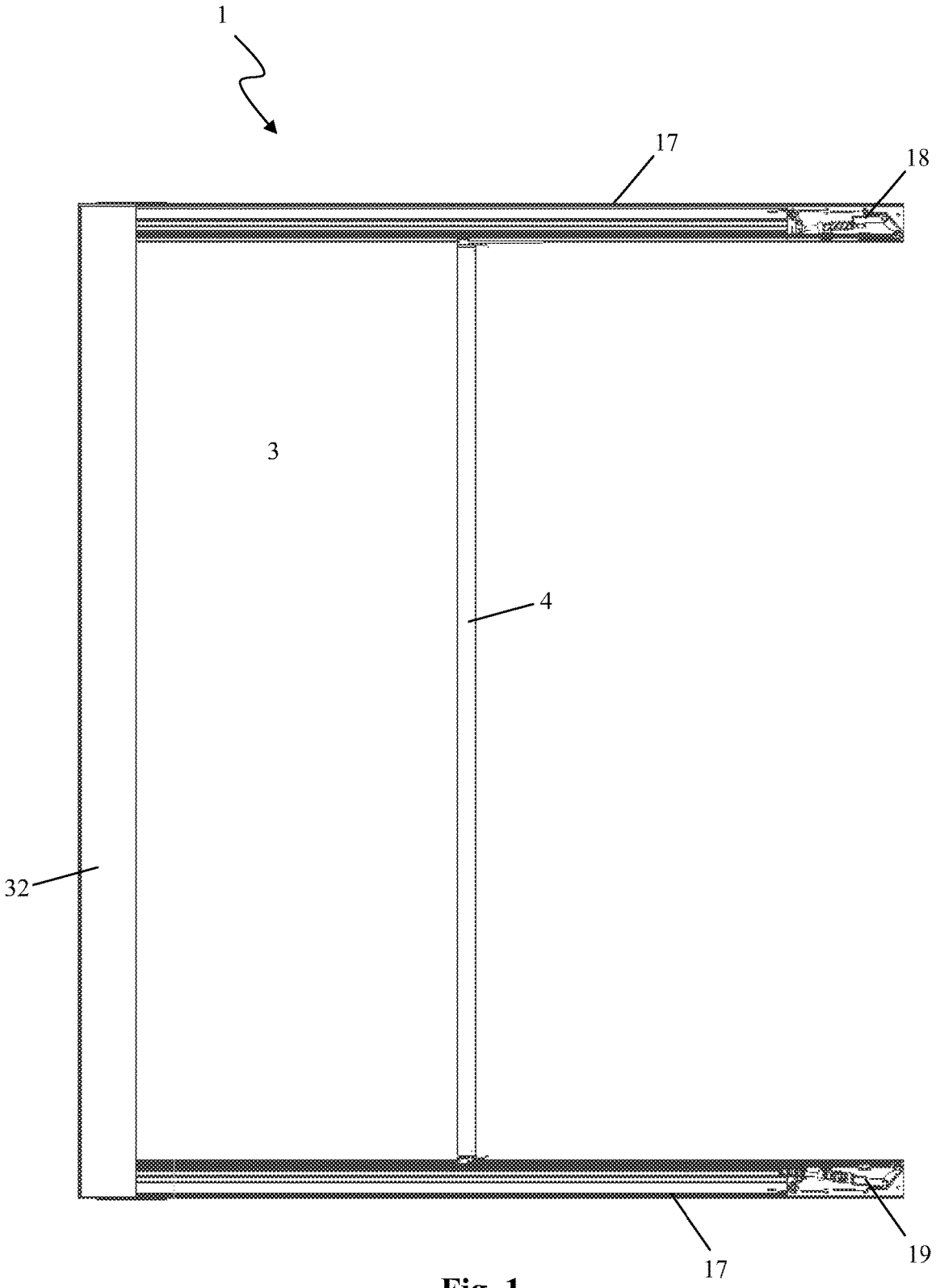

The depicted screen device (1) comprises a screen roller (2), which is accommodated in a screen box (32). In FIG. 1 the screen box is depicted, whilst in FIG. 2 the screen roller (2) is visible. This screen roller (2) is arranged vertically. A screen (3) is fastened with its one end to this screen roller (2) and at its other end to an end lath (4). By rotation of the screen roller (2), the screen (3) rolled onto and off this screen roller (2).

In the roll-up and unrolling of the screen (3), the lateral sides of the screen (3) and the end lath (4) are guided in side guides (17). For this purpose, a flexible thickening of the screen (3) is accommodated in a screen guide (31) housed in the side guide (17).

In order to keep the screen (3) tensioned in any position in the course of roll-up and unrolling, the screen device (1) comprises a tensioning system (8).

Figure 2:
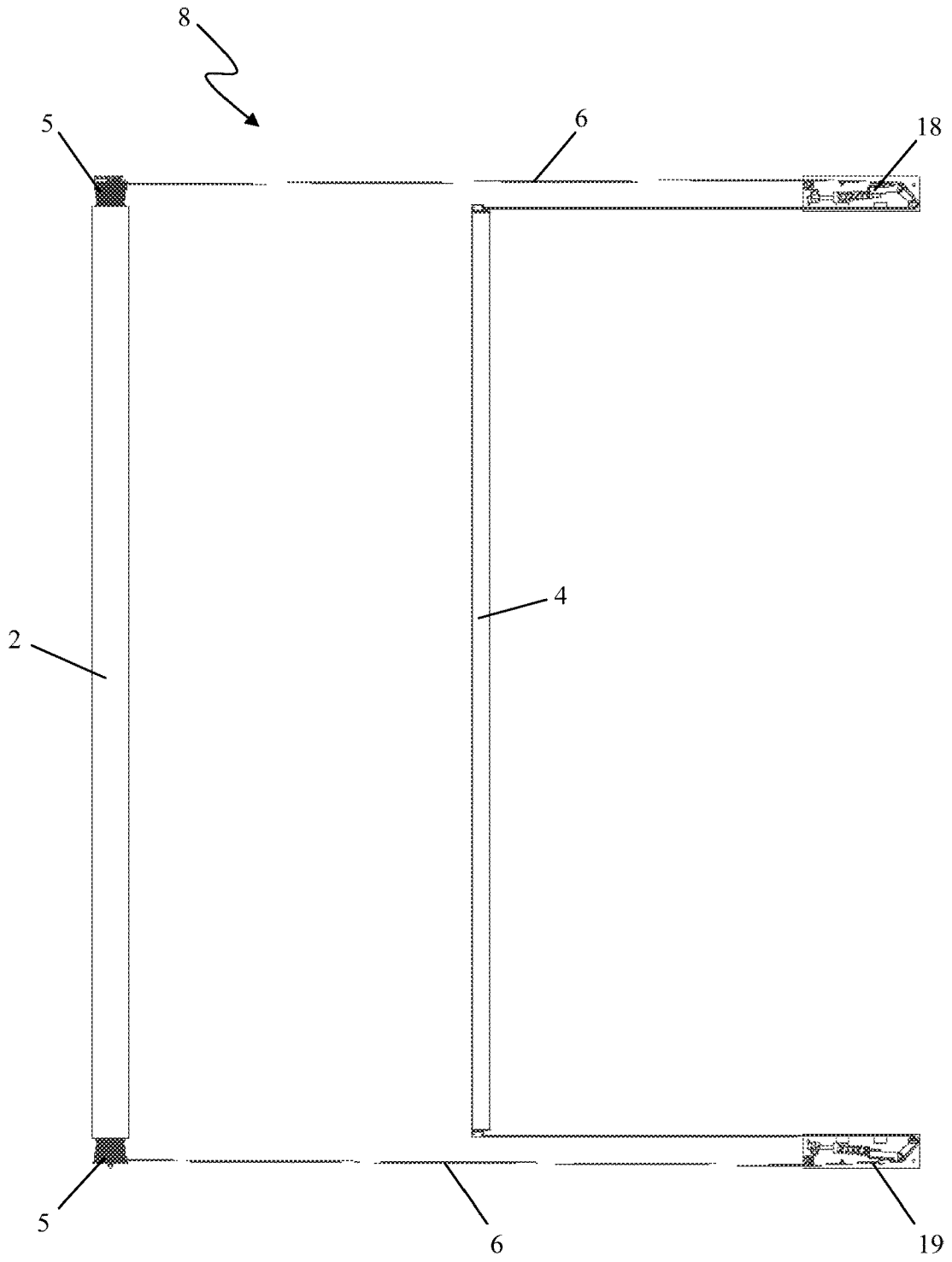
FIG. 2 the screen device from FIG. 1 is represented in front view, without the screen box, without the screen and without side guides.

As can be seen in FIG. 2, the tensioning system (8) comprises on each lateral side of the screen (3):

- a band wheel (5), which is arranged next to the screen roller (2);
- a tensioning cord (6), which can be rolled up and unrolled on this band wheel (5) and which, at its end away from the band wheel (5), is fastened to a respective end of the end lath (4);

on the side of the screen device (1) away from the screen roller (2), a reversing wheel (7), via which the tensioning cord (6) is turned;

and a spring sub-system (18, 19), which comprises a helical spring (9) for keeping the respective tensioning cord (6) under tension and which comprises adjusting means (10, 11, 14, 13, 16) for adjusting the spring force of the helical spring (9).

The spring sub-systems (18, 19) function wholly independently of each other.

In FIGS. 3 to 7, the spring sub-system (19) which is accommodated in the bottommost side guide (17) of the screen device is represented in more detail. The spring sub-system (18) which is accommodated in the topmost side guide (17) of the screen device is constructed analogously.

The spring sub-system (19) depicted in FIGS. 3 to 7*e* comprises a first pivot arm (23), which is articulately fastened to a first fixed pivot pin (20) fixedly arranged in the screen device (1). This first pivot arm (23) is additionally articulately fastened to a displaceable pivot pin (21), which is displaceably arranged in the screen device (1). This spring sub-system (19) further comprises a second pivot arm (24), which is articulately fastened to the displaceable pivot pin (21) and is articulately fastened to a second fixed pivot pin (22), which is arranged in the screen device (1).

The first pivot arm (23) comprises a first part-arm (25) and a second part-arm (26), which, with the aid of the helical spring (9), are arranged resiliently with respect to each other, so that the spring force of this helical spring (9) drives the part-arms (25, 26) apart.

The first part-arm (25) comprises a threaded rod (10) having engaging means (30) for engaging on this threaded rod (10) with a hand tool for the rotation of this threaded rod (10). The first part-arm (25) further comprises a nut (13), which comprises an internal screw thread corresponding with the external screw thread of the threaded rod (10) and is rotatably fitted on the threaded rod (10). In addition, the first part-arm (25) further comprises a cylindrical tube (15), which is fastened to the nut (13) and extends substantially on the side away from the engaging means (30) around the threaded rod (10).

The threaded rod (10) is articulately fastened to the first fixed pivot pin (20) with the aid of a holder (11). For this purpose, this threaded rod (10) is fitted through an opening in this holder (11) and fixed with the aid of a locking screw (12). If the locking screw (12) is released, then the threaded rod (10) can rotate freely in this holder (11).

The nut (13) is of bar-shaped construction, with on its outer periphery four flat sides. The flat side of the nut (13), which is arranged at the rear in the figures, is fitted against the flat front side of a guide plate (16), so that the nut (13) cannot rotate in the screen device (1). The nut (13) is able to move with respect to this guide plate (16), so that relative rotation of the nut (13) about the threaded rod (10) is left unimpeded. Upon rotation of the threaded rod (10) in the screen device (1), the nut (13) moves over the threaded rod (10) in the longitudinal direction of the threaded rod (10). The nut (13) hereupon takes with it the cylindrical tube (15), so that the latter moves telescopically with respect to the threaded rod (10).

The second part-arm (26) is at its one end articulately fastened to the displaceable pivot pin (21). At its other end, this second part-arm (26) comprises a bracing element (14), through which the cylindrical tube (15) is fitted displaceably according to the longitudinal direction of the threaded rod (10), so that this cylindrical tube (15) is telescopically displaceable in a cavity (33) of this second part-arm (26).

The helical spring (9) is fitted around the cylindrical tube (15) between the nut (13) and the bracing element (14), so that the spring force of the helical spring (9) drives the nut (13) and the bracing element (14) apart, and thus drives the part-arms (25, 26) of the first pivot arm (23) apart.

Figure 3:
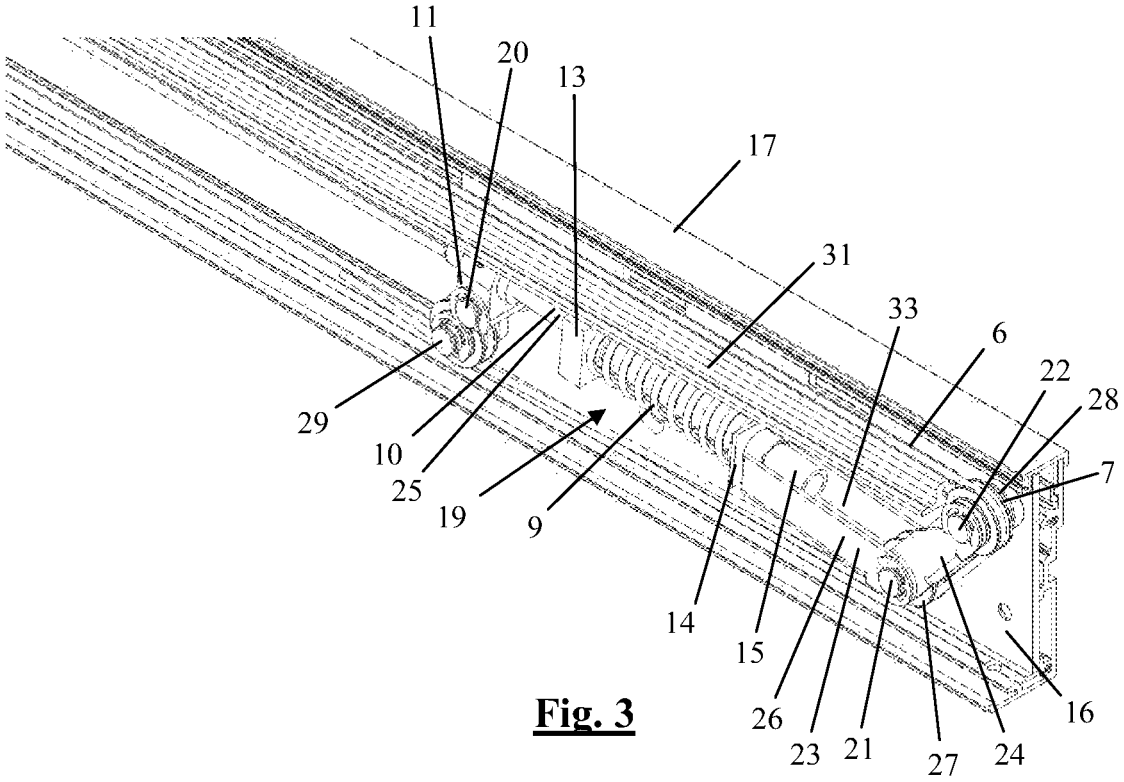
FIG. 3 the bottommost cut-out side guide of the screen device from FIG. 1 is depicted in more detail.

The guide plate (16) is fixedly arranged in the side guide (17), as can be seen in FIG. 3. The said pivot pins (20, 21, 22) are fastened to the guide plate (16). A first guide wheel (27) is fitted around the displaceable pivot pin (21). The said reversing wheel (7) is fitted around the second fixed pivot pin (22). The tensioning cord is wrapped around this first guide wheel (27) and around this reversing wheel (7). An additional guide wheel (29) is further fastened to the guide plate (16) in order to guide the tensioning cord (6) away from the spring sub-system (19).

Figure 4:
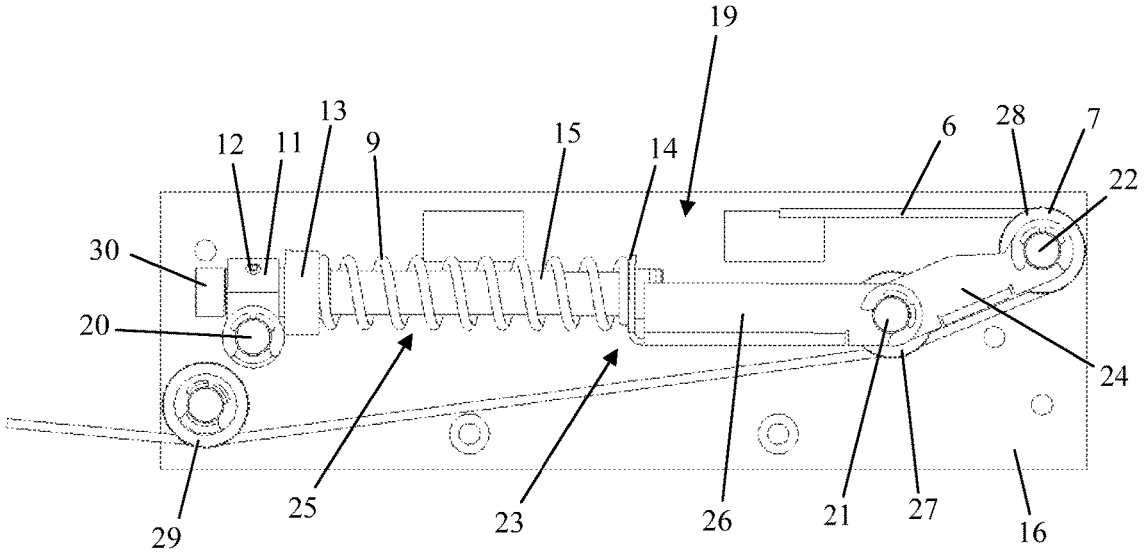
FIG. 4 the spring sub-system from the bottommost side guide of the screen device from FIG. 1 is represented separately in front view, with the spring in the untensioned state.
Figure 5:
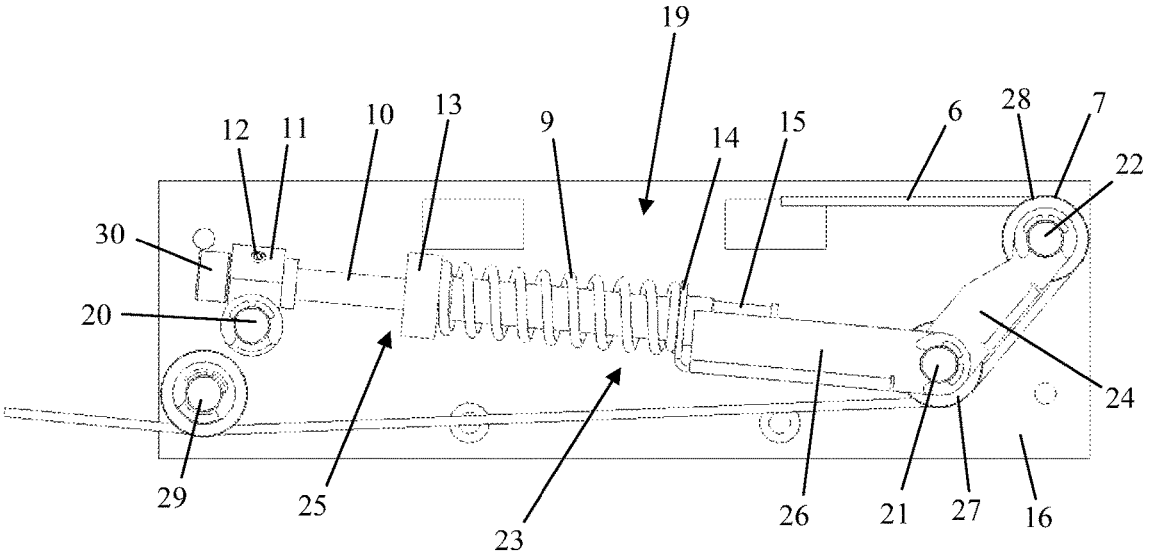
FIG. 5 the spring sub-system from the bottommost side guide of the screen device from FIG. 1 is represented separately in front view, with the spring in the tensioned state.
Figure 6:
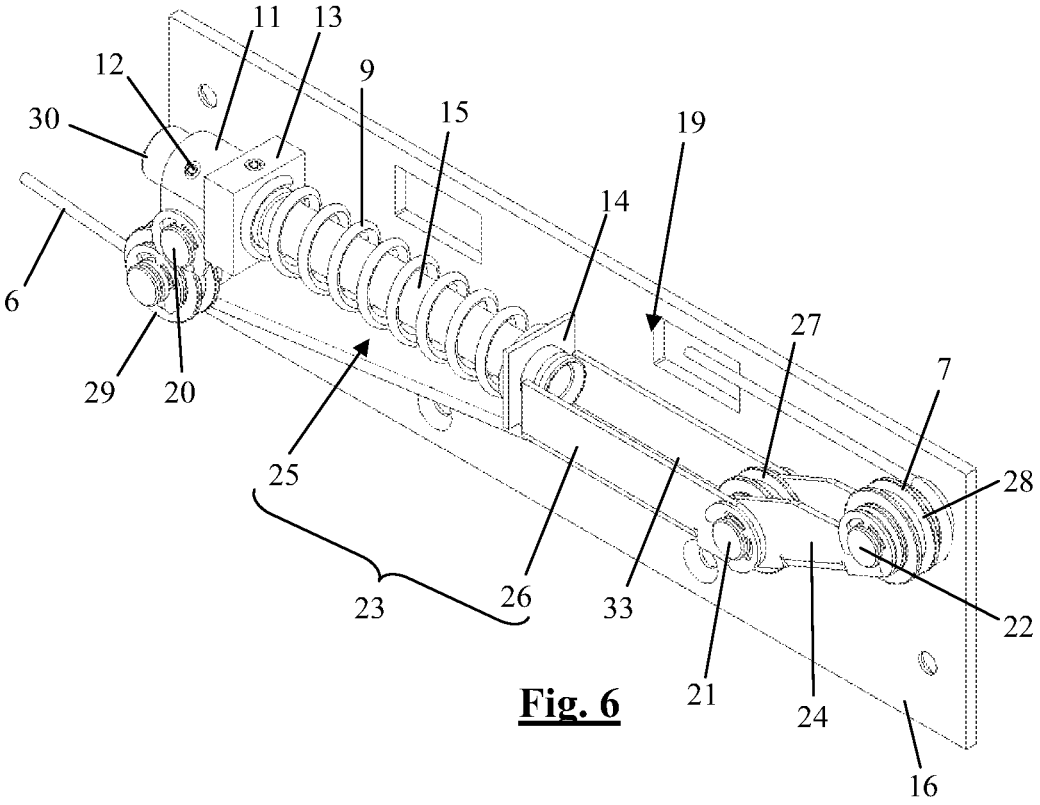
FIG. 6 the spring sub-system from the bottommost side guide of the screen device from FIG. 1 is represented separately in perspective, with the spring in the untensioned state.
Figure 7:
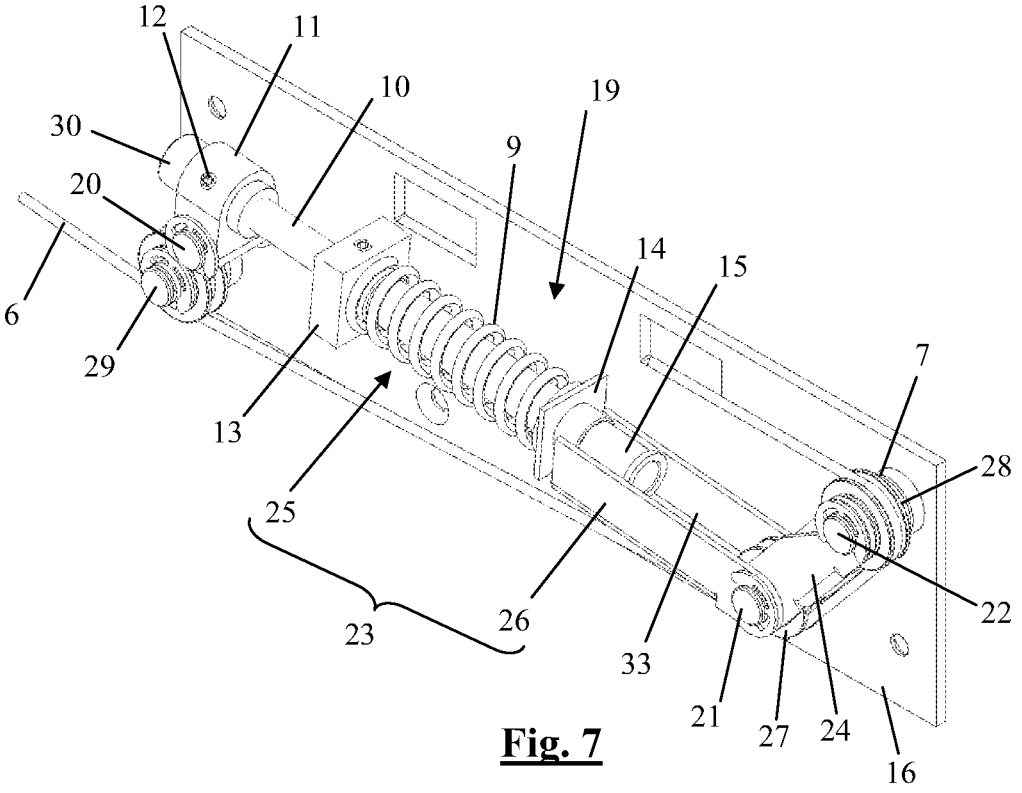
FIG. 7 the spring sub-system from the bottommost side guide of the screen device from FIG. 1 is represented separately in perspective, with the spring in the tensioned state.

If, departing from the position as depicted in FIGS. 4 and 6, the locking screw (12) is released and the threaded rod (10) is rotated, so that the nut (13) advances into the position as depicted in FIGS. 5 and 7, then the cylindrical tube (15) will move jointly with the nut (13). Since the helical spring (9) pushes the bracing element (14) away from the nut (13), the second part-arm (26) will not move along proportionally, but only insofar as the counteracting forces of the tensioning cord (6) and the pivot arms (23, 24) allow this. The cylindrical tube (15) thus moves telescopically in the cavity (33) of the second part-arm (26). The helical spring (9) is hereupon tensioned. In this way, the desired spring force of the helical spring (9) is adjusted. After this, the locking screw (12) is retightened.

The invention claimed is:

1. A screen device, comprising a screen roller;

a screen which can be rolled and unrolled on the screen roller, wherein the screen comprises:

a first end fitted to the screen roller, a second end disposed opposite to the first end, a first lateral side, and a second lateral side disposed opposite to the first lateral side;

an end lath, which is fitted to the second end of the screen roller;

a tensioning system to tension the screen when the screen is rolled and unrolled on the screen roller, comprising on each of the first and the second lateral sides of the screen:

a band wheel, which is arranged next to the screen roller;

a tensioning cord fitted on the band wheel, which can be rolled and unrolled on the band wheel;

a reversing wheel connected to the tensioning cord, via which the tensioning cord is turned; and a first spring sub-system disposed on the first lateral side of the screen and a second spring sub-system disposed on the second lateral side of the screen, wherein each of the spring sub-systems comprises:

at least one spring for keeping each of the respective tensioning cords under tension, a first pivot arm, which is articulately fastened to a first fixed pivot pin, wherein the first fixed pivot pin is fixedly arranged in the screen device and is articulately fastened to a displaceable pivot pin arranged displaceably in the screen device, and a second pivot arm, which is articulately fastened to the displaceable pivot pin and which is articulately fastened to a second fixed pivot pin, wherein the second fixed pivot pin is fixedly arranged in the screen device, wherein each of the tensioning cords is fastened to the end lath, wherein the first spring sub-system comprises a first plurality of fixtures for adjusting a spring force of the at least one spring, wherein the first pivot arm comprises a first part-arm and a second part-arm, the first part-arm and the second part-arm arranged resiliently with respect to each other such that the spring force of the at least one spring drives the part-arms apart, and wherein around each of the displaceable pivot pins is fitted a guide wheel, via which each of the respective tensioning cords is turned.

2. The screen device according to claim 1, characterized in that the screen roller is an erected screen roller.

3. The screen device according to claim 1, characterized in that the second spring sub-system comprises a second plurality of fixtures for adjusting the spring force of the at least one spring.

4. The screen device according to claim 1, characterized in that around each of the second fixed pivot pins is fitted the reversing wheel, via which each of the respective tensioning cords is turned.

5. The screen device according to claim 1, characterized in that the screen device comprises on each of the first and the second lateral sides a side guide for guiding the corresponding lateral side of the screen, and in that the tensioning system is arranged at least partially in the side guides.

6. The screen device according to claim 1, characterized in that the at least one spring comprises a helical spring.

7. The screen device according to claim 1, characterized in that the first plurality of fixtures comprises:

a threaded rod having a first end, a second end, and a screw thread, a holder, through which the first end of the threaded rod is rotatably fitted, a bracing element, through which the second end of the threaded rod is fitted displaceably, and a nut, which comprises an internal screw thread corresponding with the screw thread of the threaded rod and which is fitted between the holder and the bracing element rotatably on the threaded rod, wherein the nut, upon rotation of the threaded rod in the screen device, rotates along the length of the threaded rod, and wherein the at least one spring is fitted between the nut and the bracing element such that the spring force of the at least one spring drives the nut and the bracing element apart.

8. The screen device according to claim 7, characterized in that the nut comprises a flat side, and in that the flat side of the nut is fitted against a surface, thereby preventing rotation of the nut in the screen device.

9. The screen device according to claim 7, characterized in that the threaded rod forms part of the first part-arm of the first pivot arm, in that the holder is articulately fastened to the first fixed pivot pin in order to fasten the first part-arm articulately to the first fixed pivot pin, and in that the bracing element forms part of the second part-arm of the first pivot arm.

10. The screen device according to claim 7, wherein the screen device comprises on each of the first and the second lateral sides a side guide for guiding the corresponding lateral side of the screen, and in that the tensioning system is arranged at least partially in the side guides.

11. The screen device according to claim 7, wherein the at least one spring comprises a helical spring and wherein the helical spring is fitted around the threaded rod.

12. The screen device according to claim 11, wherein the threaded rod comprises a cylindrical tube that is fastened to the nut and that is fitted displaceably through the bracing element, and wherein the helical spring is fitted around the cylindrical tube.

* * * * *